US008258402B2

(12) United States Patent
Hagi et al.

(10) Patent No.: US 8,258,402 B2
(45) Date of Patent: Sep. 4, 2012

(54) SHIELDED WIRE-GROUNDING CONSTRUCTION

(75) Inventors: Masahiro Hagi, Yokkaichi (JP); Yoshiaki Yamano, Yokkaichi (JP); Naoya Nishimura, Yokkaichi (JP); Katsutoshi Saijo, Yokkaichi (JP); Hirotaka Baba, Yokkaichi (JP); Masaharu Ichikawa, Yokkaichi (JP); Akira Yamada, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/064,418

(22) Filed: Mar. 23, 2011

(65) Prior Publication Data

US 2011/0168423 A1 Jul. 14, 2011

Related U.S. Application Data

(63) Continuation of application No. 12/309,232, filed as application No. PCT/JP2007/064424 on Jul. 23, 2007, now abandoned.

(30) Foreign Application Priority Data

Aug. 15, 2006 (JP) ..... 2006-221683
Sep. 26, 2006 (JP) ..... 2006-260569
Jul. 9, 2007 (JP) ..... 2007-179348

(51) Int. Cl.
*H01R 4/00* (2006.01)

(52) U.S. Cl. ..... 174/84 R; 174/84 C

(58) Field of Classification Search ..... 174/74 R, 174/75 C, 78, 84 R, 84 C; 439/578–585, 439/874, 877, 885, 98–100
See application file for complete search history.

(56) References Cited

U.S. PATENT DOCUMENTS 2,678,963 A * 5/1954 Everhart ..... 174/669
2,806,215 A * 9/1957 Redslob ..... 439/868
3,517,375 A * 6/1970 Lloyd ..... 439/585
3,533,055 A * 10/1970 Zak ..... 439/882
4,697,339 A * 10/1987 Verhoeven ..... 29/828
5,267,878 A 12/1993 Shinji et al.
5,315,066 A 5/1994 Spiteri, Sr.
5,433,628 A 7/1995 Sadaishi et al.

(Continued)

FOREIGN PATENT DOCUMENTS

EP 0 627 787 A2 12/1994

(Continued)

OTHER PUBLICATIONS

Aug. 4, 2011 Supplementary European Search Report issued in EP 07 79 1157.

(Continued)

*Primary Examiner* — William Mayo, III
(74) *Attorney, Agent, or Firm* — Oliff & Berridge, PLLC

(57) ABSTRACT

The lead-out side end of a drain wire led out from a shield wire and either a conductor exposed to one end of a ground wire, to the other end of which a ground terminal is connected, or a conductor exposed to one end of a ground wire, to the other end of which a connector receiving terminal is connected, are collectively connected together by crimping by using a U-shape cross-sectioned intermediate crimp terminal formed by a pair of opposed barrels, or connected by twisting them together, or connected through a joint bus bar.

6 Claims, 14 Drawing Sheets

U.S. PATENT DOCUMENTS

| | | | | |
|---|---|---|---|---|
| 6,246,001 | B1 | 6/2001 | Fukui | |
| 6,332,807 | B1 * | 12/2001 | Asakura et al. | 439/578 |
| 6,336,827 | B1 * | 1/2002 | Akama et al. | 439/607.46 |
| 7,695,332 | B2 * | 4/2010 | Morikawa et al. | 439/877 |
| 2002/0163415 | A1 | 11/2002 | Ide et al. | |
| 2006/0216998 | A1 * | 9/2006 | Morikawa et al. | 439/610 |

FOREIGN PATENT DOCUMENTS

| | | |
|---|---|---|
| JP | A 01-151103 | 6/1989 |
| JP | U 01-107877 | 7/1989 |
| JP | A 04-237979 | 8/1992 |
| JP | U 05-050663 | 7/1993 |
| JP | U 06-088060 | 12/1994 |
| JP | A 08-339863 | 12/1996 |
| JP | A 2000-268893 | 9/2000 |
| JP | A 2001-135419 | 5/2001 |
| JP | A 2004-235029 | 8/2004 |
| JP | A 2005-093198 | 4/2005 |
| JP | A-2005-093198 | 4/2005 |

OTHER PUBLICATIONS

Feb. 7, 2012 Office Action issued in Japanese patent application No. 2007-179348 (with translation).

* cited by examiner

[Prior Art]

SHIELDED WIRE-GROUNDING CONSTRUCTION

This is a Continuation of application Ser. No. 12/309,232 filed Jan. 12, 2009, which in turn is a which is a National Phase of Application No. PCT/JP2007/064424 filed Jul. 23, 2007. The disclosure of the prior applications is hereby incorporated by reference herein in its entirety.

BACKGROUND

The present invention relates to a shielded wire-grounding construction. More particularly the present invention is intended to provide a slim construction for connecting a drain wire lead out from an end of the shielded wire and a ground wire to each other.

Conventionally it is necessary to insert a core electric wire consisting of one or a plurality of insulated coated electric wires into a braided tube made of metal fibers or into a metal foil for shielding use and connect the shielded wire composed of the braided metal tube or the metal foil covered with a sheath (insulating coating) to a ground wire.

In Japanese Patent Application Laid-Open No. 2000-268893 (patent document 1), as shown in FIG. 19, after ends of the sheath for a plurality of the shielded wires 1A through 1F is peeled to expose the braided metal, the braided metal is twisted to obtain the drain wires 1*a* through 1*f*. The drain wires 1*a* through 1*f* and the ground wire 2 are banded together with the tape 3. Collective resistance welding is performed for the drain wires 1*a* through 1*f* and the core wire 2*a* of the ground wire 2 both of which are exposed from the front end of the tape 3 to ground the ground terminal 4 connected with the other end of the ground wire 2 to a car body panel.

Instead of the drain wire obtained by twisting the braided metal of the shielded wires, by carrying out a method similar to that disclosed in the patent document 1, the ground wire can be connected to the shielded wires in which the drain wires each consisting of strands not coated with insulating coating are wired together with the core electric wires, with the drain wires in contact with the tube made of the braided metal or the metal foil.

But the collective resistance welding is performed for the drain wires 1*a* through 1*f* and the ground wire 2 by using a dedicated resistance welding equipment. Thus the resistance welding cannot be performed in a production line. Because necessary peeling length of the sheath is about 150 mm in an ordinary resistance welding work, there is room for improvement in the shielding performance. Another problem is that because the peeling length of the sheath is long, it is necessary to band the drain wires together with the tape 3 to align the front ends of the drain wires with one another before the resistance welding work is performed. Thus collective resistance welding necessitates a large number of operation steps to be performed.

Patent document 1: Japanese Patent Application Laid-Open No. 2000-268893

DISCLOSURE OF THE INVENTION

Problem to be Solved by the Invention

The present invention has been made in view of the above-described problems. It is an object of the present invention to provide a shielded wire-grounding construction and a shielded wire-grounding method in which drain wires to be connected with a ground wire are set to a possible shortest length, and a connected portion where the drain wires and the ground wire are connected with each other is small to restrain a wire harness from becoming large and which has a high shielding performance and a favorable operability.

Means for Solving the Problem

To solve the above-described problems, the present invention firstly provides a shielded wire-grounding construction including a plurality of shielded wires each having a core electric wire consisting of an insulated coated electric wire; a shielding layer, composed of a metal foil tape or a braided metal tube, which is disposed on a periphery of the core electric wire; a drain wire in contact with the shielding layer; and a sheath consisting of an insulating coating which coats the drain wire and the shielding layer, the core electric wires of a plurality of the shielded wires being connected to one connector, wherein the drain wire is lead out from a front end of each of the shielded wires at a side of connection thereof to the connector or from an intermediate position of each of the shielded wires; and lead-out side front ends of a plurality of the drain wires lead out are connected to a conductor disposed at other end of one ground wire, one end of which is connected with a ground terminal, by a collective crimping connection by using a sectionally U-shaped intermediate crimping terminal having a pair of barrels opposed to each other to form a connected portion;

the connected portion formed by the collective crimping connection is covered with a cap made of insulating resin;

the connected portion, formed by the collective crimping connection, which is covered with the cap is accommodated inside a connector cover mounted on the connector or inside a corrugate tube externally mounted on the shielded wires; and the ground terminal of the ground wire is grounded to a car body.

The shielded wire includes core wires each consisting of an insulated coated electric wire constituting signal wires. The core wires are covered with a shielding layer consisting of a metal foil or a braided metal tube. The shielding layer is covered with a sheath made of an insulating resin material. To connect the shielding layer and the ground wire to each other, the drain wire consisting of a conductor not covered with an insulating coating is brought into contact with the shielding layer covered with the sheath.

In the shielded wire-grounding construction of the present invention, the drain wire of the shielded wire is connected to the ground wire connected with a vehicle body or the like not electrically by means of resistance welding, ultrasonic welding or the like but by collective crimping connection by means of the intermediate crimping terminal. By connecting the drain wire and the ground wire with each other not by welding them to each other but by the crimping connection by means of the intermediate crimping terminal, it is possible to make the dimension necessary for a connection operation shorter than the case where the drain wire and the ground wire are connected with each other by welding them to each other. Consequently it is possible to decrease the length of the core electric wire lead out from the shielded wire and the drain wire also lead out therefrom. More specifically the length of a portion of the drain wire lead out from the end of the shielded wire to connect the drain wire to the ground wire by the crimping connection by means of the intermediate crimping terminal is 40 mm at the shortest. The minimum length of the portion of the drain wire lead out from the end of the shielded wire can be decreased to not more than the half of the length of the portion of the drain wire lead out from the end thereof in a conventional method of welding them to each other. Consequently it is possible to greatly decrease the peeling length of the shielded wire and prevent the shielded wire from deteriorating its performance of shielding the shielded wire, but it is possible to impart a high shielding performance thereto. The resistance welding necessitates the drain wire and the ground wire and other component parts to be moved to a resistance welding machine to perform a welding operation. On the other hand, the crimping connection allows a crimping operation to be accomplished in one line. Thus it is possible to decrease the number of operation steps and perform the operation efficiently.

It is preferable that the ground terminal connected with the one end of the ground wire is provided with a water-stop portion at a connected portion at which the ground wire and the ground terminal are connected with each other by crimping connection; and the ground terminal is directly grounded to a car body.

That is, when the terminal is crimped to the ends of the drain wires and inserted into a connector to connect the terminal to the terminal disposed at the end of the ground wire inside the connector, there is a fear that water penetration occurs through the drain wires. But as described above, by providing the ground terminal of the ground wire connected with the drain wires with the water-stop portion and directly connecting and fixing the ground terminal to the car body or the like with a bolt or the like, it is possible to securely prevent water penetration from occurring through the drain wires.

Therefore it is unnecessary to waterproof the connected portion at which the ends of the drain wires and the ground wire are connected with each other and prevent the connected portion from becoming large, thus allowing the connected portion to be slim.

The water-stop portion is formed by dripping silicone to the connected portion at which the ground terminal and the ground wire are connected with each other or mounting a water-stop rubber stopper thereon.

The present invention secondly provides a shielded wire-grounding construction including a plurality of shielded wires each having a core electric wire consisting of an insulated coated electric wire; a shielding layer, composed of a metal foil tape or a braided metal tube, which is disposed on a periphery of the core electric wire; a drain wire in contact with the shielding layer; and a sheath consisting of an insulating coating which coats the drain wire and the shielding layer, the core electric wires of a plurality of the shielded wires being connected to one connector, wherein the drain wire is lead out from a front end of each of the shielded wires at a side of connection thereof to the connector or from an intermediate position of each of the shielded wires; and lead-out side front ends of a plurality of the drain wires lead out are connected to one end of a single core wire of a ground wire coated with an insulating coating by a collective crimping connection by using a sectionally U-shaped intermediate crimping terminal having a pair of barrels opposed to each other to form a connected portion;

a connector accommodation terminal is connected to other end of the single core wire of the ground wire by crimping connection; and the connector accommodation terminal and a terminal connected to an end of the core electric wire by crimping connection are inserted into the connector and locked thereto to connect the connector accommodation terminal to a ground circuit.

In the first invention, the ground terminal disposed at one end of the ground wire is connected to a car body panel. The second invention is different from the first invention in that the terminal disposed at the one end of the ground wire is accommodated inside the connector.

Therefore in the second invention, it is unnecessary to wire the ground wire to the car body panel and possible to decrease the length of the ground wire. Thus it is possible to simplify the shielded wire-grounding construction.

Furthermore because the ground wire is composed of the single core wire whose conductor is covered with the insulating coating, no gap is formed between the conductor and the insulating coating. Therefore it is possible to prevent water which has penetrated into the connected portion at which the drain wires and the ground wire are connected with each other from penetrating into the connector, because there is no gap between the conductor of the ground wire and the insulating coating.

The connector accommodation terminal is provided with a water-stop portion at a connected portion at which the connector accommodation terminal and the ground wire are connected with each other by crimping connection.

The water-stop portion is formed by dripping silicone to the connected portion at which the connector accommodation terminal and the ground wire are connected with each other or by mounting a water-stop rubber stopper thereon. Thereby it is possible to prevent water from penetrating into the connector from the end of the ground wire connected with the connector.

The connector accommodates a crimping terminal connected with an end of a core electric wire lead out from each of the shielded wires and the connector accommodation terminal connected with the other end of the ground wire; and the connector accommodation terminal connected with the ground wire is connected to a ground circuit of a circuit member accommodated in an electronic control unit to which the connector is connected.

In the above-described construction, by connecting the connector connected with the end of the core electric wire and that of the ground wire to the electronic control unit, the connector accommodation terminal connected with the ground wire is connected to the ground circuit of the circuit member accommodated in the electronic control unit. Therefore it is possible to accomplish the ground connection.

More specifically the circuit member is composed of a printed-circuit board. A terminal member connected to a conductor constructing the ground circuit of the printed-circuit board by soldering is connected with the connector accommodation terminal connected with the ground wire.

The present invention thirdly provides a shielded wire-grounding construction including a plurality of shielded wires each having a core electric wire consisting of an insulated coated electric wire; a shielding layer, composed of a metal foil tape or a braided metal tube, which is disposed on a periphery of the core electric wire; a drain wire in contact with the shielding layer; and a sheath consisting of an insulating coating which coats the drain wire and the shielding layer, the core electric wires of a plurality of the shielded wires being connected to one connector, wherein the drain wire is lead out from a front end of each of the shielded wires at a side of connection thereof to the connector or from an intermediate position of each of the shielded wires; and strands of core wires exposed from lead-out side front ends of a plurality of the drain wires lead out and strands of core wires exposed from other end of one ground wire, one end of which is connected with a ground terminal, are twisted; the twisted strands are covered with a heat-shrinkable tube having a thermoplastic adhesive agent in an inner layer thereof, and the heat-shrinkable tube is thermally shrunk and adheres to the twisted strands to electrically connect the twisted strands to each other; and an electrically connected portion of the twisted strands covered with the heat-shrinkable tube is accommodated inside a connector cover mounted on the connector or inside a corrugate tube externally mounted on the shielded wires; and the ground terminal of the ground wire is grounded to a car body.

More specifically the drain wires are untwisted, and the ground wire is also untwisted when the ground wire is composed of twisted strands. Thereafter strands of the drain wires and those of the ground wire are entwined and twisted to form the connected portion. Thereafter the connected portion is covered with the heat-shrinkable tube and heated to shrink the heat-shrinkable tube so that it adheres to the connected portion.

In the above-described construction, the connected portion at which the drain wires and the ground wire are connected with each other is covered with the heat-shrinkable tube to prevent the strands of the drain wires and those of the ground wire from being untwisted. Thereby it is possible to secure an electrical connection between the drain wires and the ground wire.

It is possible to protect the connected portion at which the drain wires and the ground wire are connected with each other by means of the heat-shrinkable tube.

It is preferable that drain wires lead out from two to five shielded wires are connected with the conductor exposed from the end of the ground wire; and the connected portion is covered with a cap made of insulating resin.

It is possible to collectively connect the drain wires of two to five shielded wires to one ground wire by using the intermediate crimping terminal by the crimping connection or by twisting the drain wires and the ground wire. This construction allows a plurality of the drain wires to be simultaneously connected with the ground wire. As described above, by covering the connected portion with the cap made of the insulating resin, the connected portion can be easily protected.

It is preferable that a portion of a sheath is peeled at a front part of each of the shielded wires to lead out the drain wire and the core electric wire in a length of 40 to 80 mm; and a connected portion at which the drain wires and the ground wire are connected with each other is accommodated in an inside of a connector cover into which a crimping terminal connected with the end of the core electric wire is inserted and locked thereto, a corrugate tube externally mounted on the shielded wires or a corrugate tube externally mounted on the shielded wires and an electric wire other than the shielded wire.

As described above, in the present invention, the length of the drain wires connected with the ground wire is set short. Therefore it is possible to accommodate the connected portion inside an accommodation portion provided in the connector cover mounted on the connector into which the end of the core electric wire is inserted and locked thereto or inside the corrugate tube externally mounted on the core electric wire without doubling the drain wires in an excess portion thereof.

When the connected portion at which the drain wires and the ground wire are connected with each other is accommodated inside the connector cover, it is unnecessary to hold the connected portion along the peripheral surface of the shielded wire by performing a tape-winding operation. Thus it is possible to make the wire harness composed of a plurality of the shielded wires slim.

By accommodating the connected portion at which the drain wires and the ground wire are connected with each other inside the connector cover or inside the corrugate tube, the connected portion is little influenced by external vibration and heat. Thereby it is possible to enhance the protection performance.

As described above, a ground wire for relay connection use for connectedly relaying a plurality of drain wires is provided to connect a conductor disposed at one end of the ground wire for relay connection use to the ground wire and a part of the drain wires and connect a conductor disposed at other end of the ground wire for relay connection use to another part of the drain wires.

In the above-described construction, when a plurality of connected portions where ends of the drain wires are connected with each other is formed, all the drain wires can be connected with the ground wire by connecting the connected portions to each other through the ground wire for relay connection use and by connecting the ground wire to one connected portion. Thereby it is unnecessary to provide each connected portion with the ground wire, one end of which is connected with the ground terminal or with the connector accommodation terminal and thus possible to decrease the number of the ground terminals or that of the connector accommodation terminals.

The shielded wire-grounding construction of the first invention is formed by a shielded wire-grounding method including the steps of:

leading out a drain wire and a core electric wire by peeling a portion of a sheath at a front part of each of shielded wires in a necessary dimension;

connecting a crimping terminal to an end of the core electric wire lead out from each of the shielded wires by crimping connection; and connecting front ends of the drain wires lead out from the shielded wires to a conductor exposed from other end of a ground wire, one end of which is connected with a ground terminal by a collective crimping connection by using a sectionally U-shaped intermediate crimping terminal having a pair of barrels opposed to each other.

The shielded wire-grounding construction of the second invention is formed by a shielded wire-grounding method including the steps of:

leading out a drain wire and a core electric wire by peeling a portion of a sheath at a front part of each of shielded wires in a necessary dimension;

connecting a crimping terminal to an end of the core electric wire lead out from each of the shielded wires by crimping connection; and connecting front ends of the drain wires lead out from the shielded wires to a conductor disposed at other end of a ground wire which consists of a single core wire covered with an insulating coating, a conductor disposed at one end of the ground wire being connected with a connector accommodation terminal accommodated inside a connector, by a collective crimping connection by using a U-shaped intermediate crimping terminal having a pair of barrels opposed to each other or by twisting the drain wires and the ground wire.

In the above-described methods, in connecting the drain wires of the shielded wire and the ground wire with each other, it is unnecessary to transport the shielded wire, the ground wire, and other component parts from a successive production line to a welding apparatus and possible to accomplish the above-described all production steps in one production line. Thus it is possible to enhance the operation efficiency.

Further as described above, because the drain wires and the ground wire are connected with each other by the crimping connection by using the intermediate crimping terminal or by twisting the drain wires and the ground wire, the length of the exposed portion of each of the drain wires is short. Thus it is unnecessary to perform a tape-winding operation to align the front ends of the drain wires with each other and possible to decrease the number of operation steps.

The above-described steps can be performed at a desired order. It is preferable that a step of connecting the crimping terminal to the core electric wire by crimping connection is performed continuously with a step of connecting the drain wires and the ground wire to each other by using the intermediate crimping terminal by crimping connection. In this method, because the step of connecting the crimping terminal to the core electric wire by crimping connection is performed continuously with the step of connecting the drain wires and the ground wire to each other by crimping connection, it is possible to efficiently perform the crimping connection operation.

In connecting an electric wire other than the shielded wire to the connector in addition to the core electric wire of the shielded wire, the crimping terminal may be connected with ends of the electric wire other than the shielded wire at the step where the crimping connection operation is performed or the drain wires and the ground wire may be connected with each other by the crimping connection after the core electric wire of the shielded wire and the electric wire other than the shielded wire are connected with the connector.

When a conventional art of connecting the drain wires and the ground wire to each other by resistance welding is used, it is necessary to connect the electric wire other than the shielded wire to the connector, perform the resistance welding to connect the drain wires and the ground wire to each other, and connect the core electric wire of the shielded wire to the connector. But in the present invention, when the drain wires and the ground wire are connected to each other by the crimping connection, it is possible to enhance the degree of freedom in executing the production steps, as described above.

As described above, by accommodating the connected portion at which the drain wires and the ground wire are connected with each other inside the connector cover or inside the corrugate tube, it is unnecessary to separately form the portion where the connected portion is disposed and fix the connected portion to the core electric wire or the like with a tape. Thus it is possible to enhance the workability.

The present invention fourthly provides a shielded wire-grounding construction including a plurality of shielded wires each having a core electric wire consisting of an insulated coated electric wire; a shielding layer, composed of a metal foil tape or a braided metal tube, which is disposed on a periphery of the core electric wire; a drain wire in contact with the shielding layer; and a sheath consisting of an insulating coating which coats the drain wire and the shielding layer, the core electric wires of a plurality of the shielded wires being connected to one connector, wherein the drain wire is lead out from a front end of each of the shielded wires at a side of connection of each of the shielded wires to the connector; a connector accommodation terminal is connected to lead-out side front ends of a plurality of the drain wires lead out by crimping connection, and a connector accommodation terminal is connected to other end of a ground wire, one end of which is connected with a ground terminal;

the connector accommodation terminal of the drain wires and that of the ground wire are connected to each other by inserting the connector accommodation terminals into a joint connector accommodating a joint bus bar and locking the connector accommodation terminals thereto;

the joint connector is fixed to an inner surface of a connector cover mounted on the connector with an adhesive agent or accommodated inside a connector accommodation portion formed on an inner wall of the connector cover and locked thereto; and the ground terminal of the ground wire is grounded to a car body.

In the shielded wire-grounding construction, the drain wires of the shielded wire are connected with the ground wire not electrically by means of resistance welding, ultrasonic welding or the like but through the joint bus bar. By connecting the drain wires and the ground wire with each other not by welding, but by connecting the terminals connected with the drain wires and the ground wire to the joint bus bar by crimping connection or pressure welding, it is possible to make the dimension necessary for the connection operation of connecting the terminals to the drain wires to be shorter than the case where the terminals are connected to the drain wires by welding. Consequently it is possible to decrease the length of the core electric wire lead out from the shielded wire and the drain wires also lead out therefrom. Thereby it is possible to greatly decrease the peeling length of the shielded wire, prevent the deterioration of the shielding performance of the shielded wire, and impart a high shielding performance thereto. The resistance welding necessitates the shielded wire, the ground wire, and other component parts to be moved to a resistance welding machine to perform a welding operation. On the other hand, the crimping connection between the terminals allows an operation to be accomplished in one line. Thus it is possible to decrease the number of operation steps and perform the operation efficiently.

In the above-described construction, when the joint connector is accommodated inside the connector cover, it is unnecessary to hold the connected portion at which the drain wires and the ground wire are connected with each other along the periphery of the shielded wire by performing a tape-winding operation. Thereby it is possible to make the wire harness composed of a plurality of shielded wires slim.

Further the joint connector is little influenced by external vibration and heat. Thus it is possible to enhance the performance of protecting the connected portion.

By fixing the joint connector to the inner wall of the connector cover with the adhesive agent, it is possible to accommodate the joint connector inside the connector cover without complicating the construction of the connector cover.

The shielded wire-grounding construction of the present invention is formed by a shielded wire-grounding method including the steps of:

leading out a drain wire and a core electric wire by peeling a portion of a sheath at a front part of each of shielded wires in a necessary dimension;

connecting a terminal to an end of the core electric wire lead out from each of the shielded wires and that of the drain wire lead out therefrom and to a conductor exposed from other end of a ground wire, one end of which is connected with a ground terminal;

inserting the terminal crimped to the end of the core electric wire into a cavity of a connector and locking the terminal thereto;

connecting the terminal of the drain wire and the terminal of the ground wire to a joint bus bar disposed inside a joint connector to connect the drain wires and the ground wire to each other fixing the joint connector to an inner wall of a connector cover mounted on the connector; and mounting the connector cover on the connector.

Alternatively the shielded wire-grounding construction of the present invention is formed by carrying out a shielded wire-grounding method including the steps of:

leading out a drain wire and a core electric wire by peeling a portion of a sheath at a front part of each of shielded wires in a necessary dimension;

connecting a terminal to an end of the core electric wire lead out from each of the shielded wires and that of the drain wire lead out therefrom and to a conductor exposed from other end of a ground wire which consists of a single core wire covered with an insulating coating, a conductor disposed at one end of the ground wire being connected with a connector accommodation terminal accommodated inside a connector;

inserting the crimping terminal crimped to the end of the core electric wire and the connector accommodation terminal connected to the one end of the ground wire into a cavity of the connector and locking the crimping terminal and the connector accommodation terminal thereto;

connecting the terminal of the drain wire and the terminal of the ground wire to a joint bus bar disposed inside a joint connector to connect the drain wires and the ground wire to each other;

fixing the joint connector to an inner wall of a connector cover mounted on the connector; and mounting the connector cover on the connector.

By forming the shielded wire-grounding construction by carrying out the above-described shielded wire-grounding method, in connecting the drain wires of the shielded wire and the ground wire to each other, it is unnecessary to transport the shielded wire, the ground wire, and other component parts from a successive production line to a welding apparatus and possible to accomplish the above-described all production steps in one production line. Thus it is possible to enhance the operation efficiency.

The joint connector may be fixed to the inner wall of the connector cover after or before the drain wire and the ground wire are connected to the joint connector.

SUMMARY

As described above, in the present invention, the drain wires of the shielded wire and the ground wire are connected to each other by the crimping connection by using the intermediate crimping terminal or by twisting the drain wires and the ground wire or through the joint bus bar. Therefore as compared with the case in which the drain wires and the ground wire are connected to each other by welding the portion of the drain wire to be connected and the portion of the ground wire to be connected to each other, it is possible to decrease the lead-out length of the drain wire to 40 mm at the shortest. Because it is possible to decrease the peeling length of the shielded wire by the above-described length, it is possible to enhance the shielding performance of shielded wire.

Further the peeling length of the sheath of the shielded wire and the length of the exposed portion of each drain wire are short. Therefore in connecting a plurality of the drain wires to the ground wire, it is unnecessary to perform a tape-winding operation to align the front ends of the drain wires with each other. Thus it is possible to decrease the number of operation steps.

The length of each drain wire from the rear end to the connected portion at which the drain wires and the ground wire are connected with each other or to the joint connector is short. Therefore the length from the position at which the shielded wire is peeled to the connector into which the terminal disposed at the end of the core electric wire is inserted and locked thereto is short. Thus it is possible to accommodate the connected portion at which the drain wires and the ground wire are connected with each other or the joint connector inside the connector cover mounted on the connector without doubling the drain wires in an excess portion thereof. Consequently it is unnecessary to hold the connected portion at which the drain wires and the ground wire are connected with each other or the joint connector on the shielded wire by winding a tape around the peripheral surface of the shielded wire and restrain the wire harness composed of one shielded wire or a plurality of the bundled shielded wires from becoming locally large and make the wire harness slim.

BRIEF DESCRIPTION OF THE DRAWINGS

FIG. 4 shows a state in which a connector is connected with an end of a wire harness, in which

EXPLANATION OF REFERENCE NUMERALS AND SYMBOLS

Figure 1:
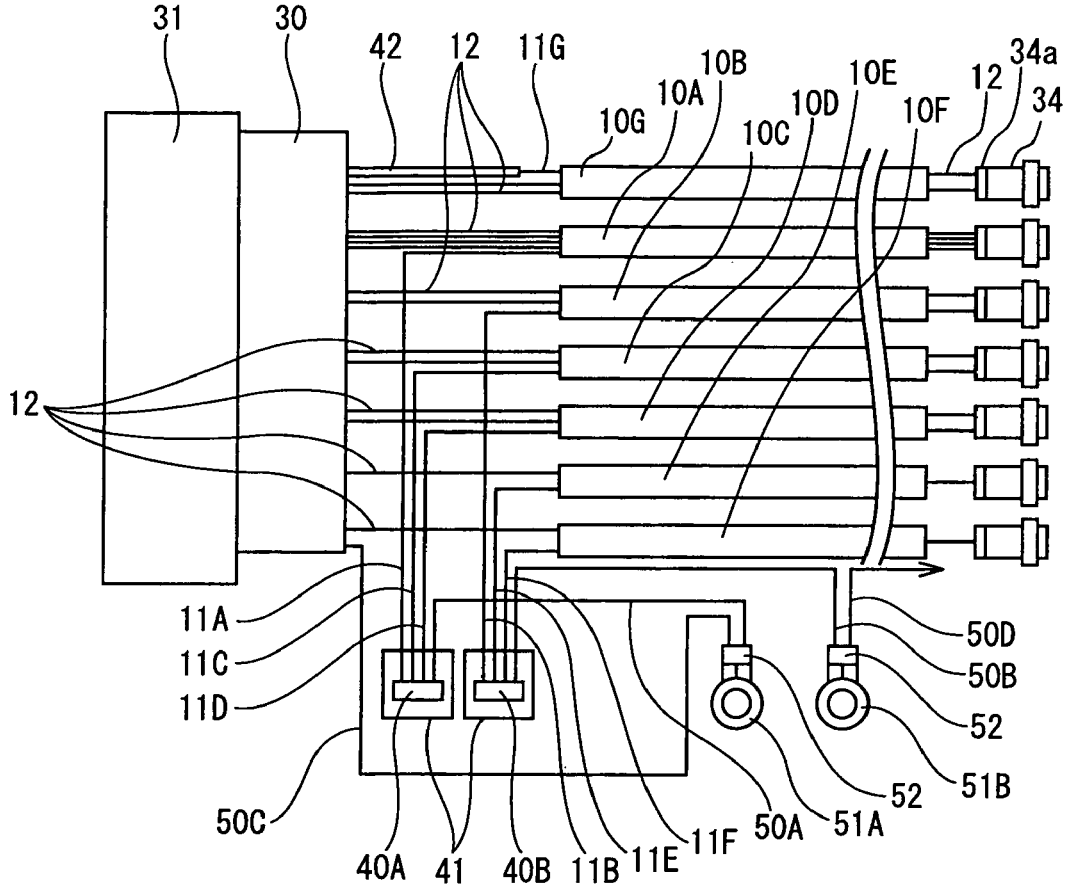
FIG. 1 is a schematic view showing a shielded wire-grounding construction of a first embodiment of the present invention.

10: shielded wire
11: drain wire
12: core electric wire
13: shielding layer
14: sheath
20: electric wire other than shielded wire
30: connector
32: connector cover
32*e'*: connector accommodation portion
33: corrugate tube

40: intermediate crimping terminal
41: cap
44: heat shrinkable tube
45: metal tube
50, 53: ground wire
51: ground terminal
52, 57: water-stopping rubber stopper (water-stop portion)
56: connector accommodation terminal to be accommodated in connector
58: ground wire for relay connection
60: joint connector
61: joint bus bar
62, 63: crimping terminal
64: adhesive agent
W/H: wire harness

DETAILED DESCRIPTION OF EMBODIMENTS

The embodiments of the present invention are described below with reference to the drawings.

FIGS. 1 through 6 show a first embodiment of the present invention.

Figure 4A:
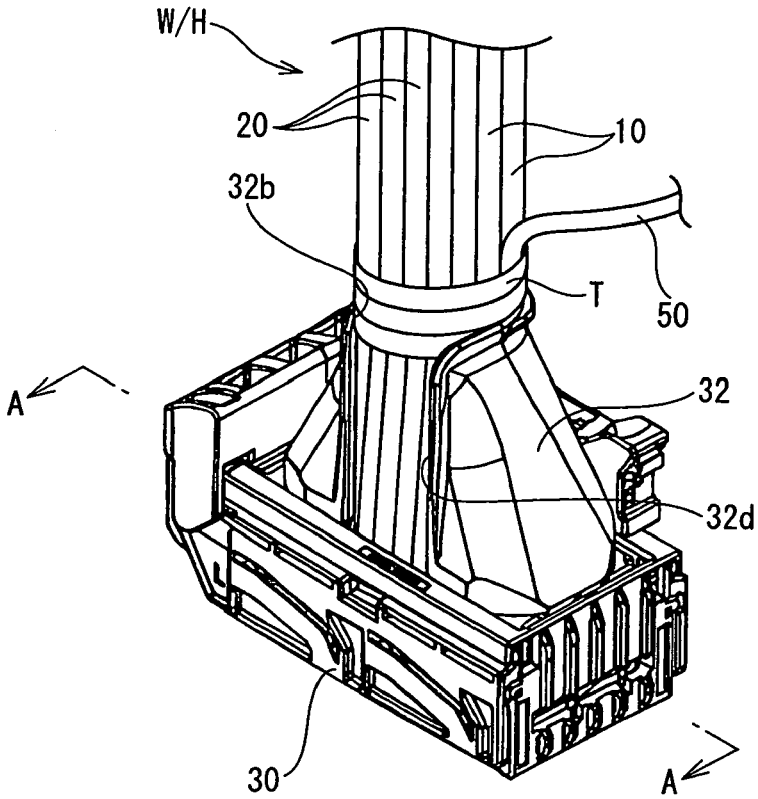
FIG. 4(A) is a perspective view.

As shown in FIG. 4, a wire harness W/H composed of a plurality of shielded wires 10 and an electric wire 20 other than the shielded wire 10 is wired in an engine room of a car. An end of the wire harness W/H is connected to one connector 30 connected to a fuel injection control apparatus 31 by fitting the connector 30 in the fuel injection control apparatus 31.

Figure 2:
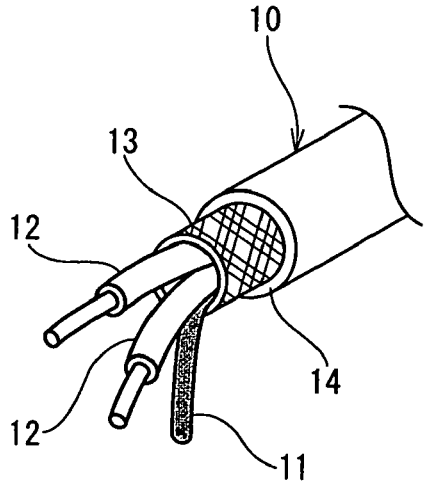
FIG. 2 is a perspective view showing a shielded wire.

As shown in FIG. 2, the shielded wire 10 is composed of one or a plurality of core wires 12 consisting of insulated coated electric wires which constitute one or a plurality of signal wires and one drain wire 11. The drain wire 11 and the core wires 12 are coated with a shielding layer 13 consisting of a metal foil or a tube of a braided metal and a sheath 14 made of an insulating resin material, with the shielding layer 13 coated with the sheath 14. The drain wire 11 is brought into contact with the shielding layer 13 to make the shielding layer 13 and drain wire 11 electrically conductive.

The sheath 14 and the shielding layer 13 of the shielded wire 10 are cut to peel a part of the sheath 14 and the shielding layer 13 in a length of about 40 mm from a front end of the shielded wire 10 to lead out the drain wire 11 and the core wire 12 from the front end of the shielded wire 10.

As shown in FIG. 1, the wire harness W/H has seven shielded wires 10. These shielded wires include a shielded wire 10A connected with a knock sensor, a shielded wire 10B connected with an engine revolution sensor, shielded wires 10C, 10D connected with left and right air-fuel ratio sensors respectively, shielded wires 10E, 10F connected with left and right oxygen sensors respectively, and a shielded wire 10G connected with a throttle sensor. The shielding layer 13 of each of the shielded wires 10A, 10B consists of the tube of the braided metal, whereas the shielding layer 13 of each of the remaining shielded wires 10C through 10G consists of the metal foil. In FIG. 1, the electric wire 20 other than the shielded wire 10 of the wire harness W/H is not shown.

Of the shielded wires 10A through 10G, other end of the ground wire 50 whose one end is connected with a ground terminal 51 tightened to a car body with a bolt is connected with the drain wires 11A through 11F of the shielded wires 10A through 10F by means of an intermediate crimping terminal 40 by crimping connection.

Figure 3A:
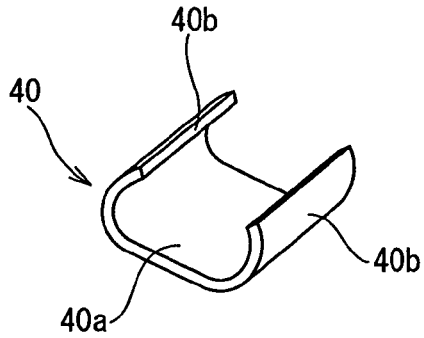
FIG. 3(A) is a perspective view showing a crimping terminal.
Figure 3B:
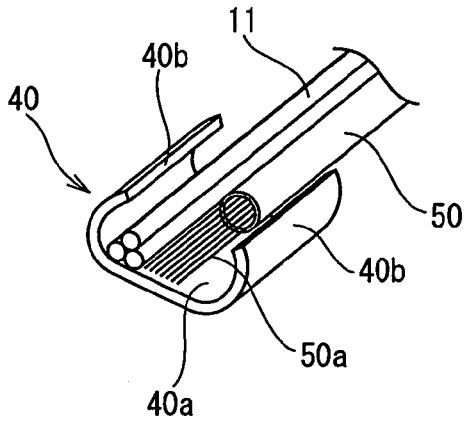
FIGS. 3(B) and 3(C) show a method of connecting a drain wire and a ground wire with each other by crimping connection.
Figure 3C:
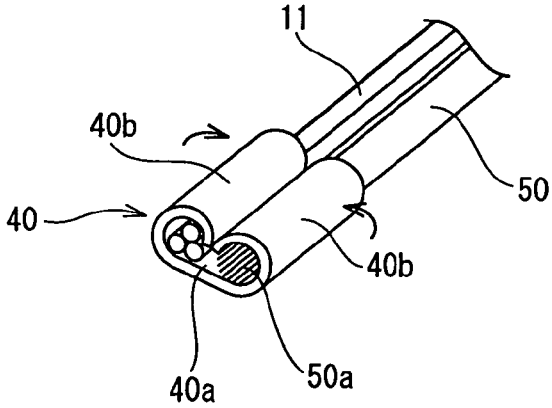

More specifically, as shown in FIG. 3, in the intermediate crimping terminal 40, a pair of crimping barrels 40*b* is provided at both sides of a substrate portion 40*a* consisting of a conductive metal plate. Thus the intermediate crimping terminal 40 is U-shaped in section. Ends of the drain wires 11 parallel with one another and exposed ends of core wires 50*a* of the ground wire 50 are disposed on the substrate portion 40*a*. The crimping barrels 40*b* are caulked inward to bring the substrate portion 40*a* and the crimping barrels 40*b* into close contact with the drain wires 11 and the ground wire 50 to collectively connect the drain wires 11 and the ground wire 50 with each other by the crimping connection. A connected portion at which the drain wires 11 and the ground wire 50 is connected with each other by means of the intermediate crimping terminal 40 by the crimping connection is covered with a bottomed cylindrical cap 41 made of insulating resin.

In the first embodiment, as shown in FIG. 1, the three drain wires 11A, 11C, and 11D and a ground wire 50A are connected with each other by means of an intermediate crimping terminal 40A by the crimping connection, and the three drain wires 11B, 11E, and 11F and a ground wire 50B are connected with each other by means of an intermediate crimping terminal 40B by the crimping connection. A ground wire 50C connected with the connector 30 is connected with a ground terminal 51A connected with the ground wire 50A to use the ground wire 50C for grounding a circuit of the fuel injection control apparatus 31. A ground wire 50D for grounding a circuit inside the cabin is connected with a ground terminal 51B connected with the ground wire 50B.

A drain wire 11G of the remaining shielded wire 10G is inserted through a waterproof shrinkable tube 42 and connected with the connector 30.

A water-stop rubber stopper 52 is mounted on a connected portion at which the ground wire 50 and the ground terminal 51 are connected with each other, a connected portion at which the connector 30 and the core electric wire 12 of the shielded wire 10 are connected with each other, a connected portion at which the connector 30 and the drain wire 11G are connected with each other, and a connected portion at which the connector 30 and the electric wire 20 other than the shielded wire 10 are connected with each other to form a water-stop portion so that the connector 30 is waterproofed.

Instead of the water-stop rubber stopper, silicone may be dripped to a water-stop portion to form the water-stop portion.

As shown in FIG. 4, a connector cover 32 is mounted on a wire harness-connected surface of the connector 30 to cover the connected portion at which the connector 30 and the wire harness W/H are connected with each other.

Figure 4B:
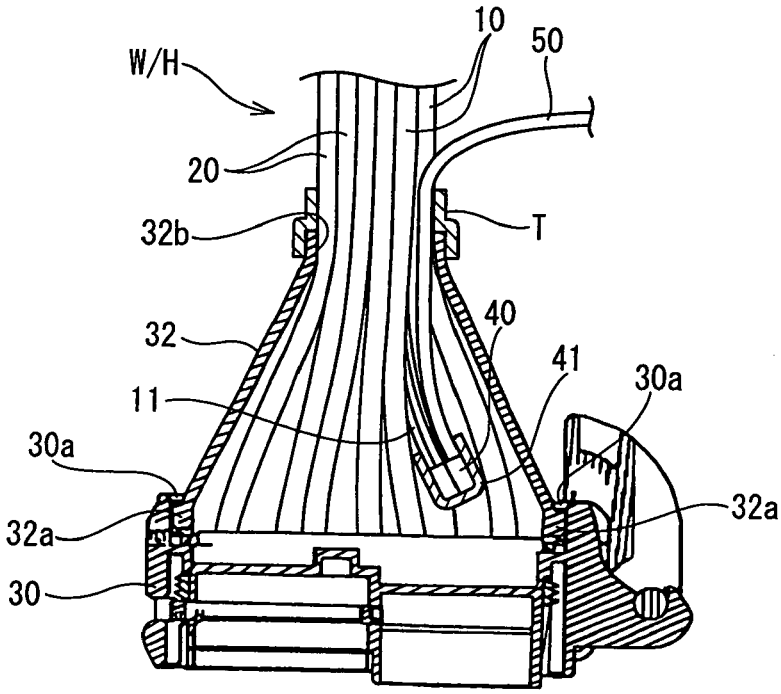
FIG. 4(B) is a sectional view taken along a line A-A.
Figure 5:
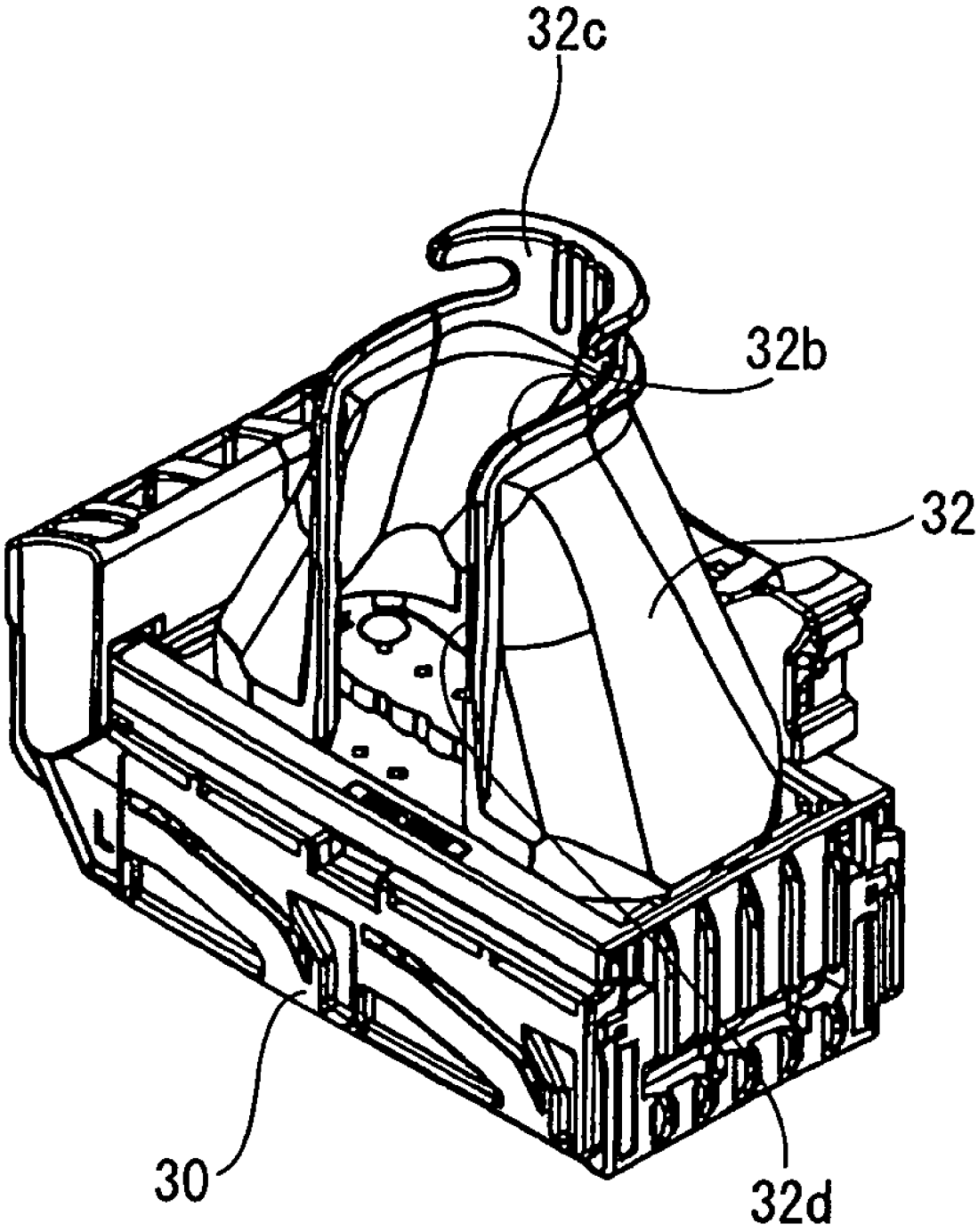
FIG. 5 is a perspective view showing a state in which a connector cover is mounted on the connector.

As shown in FIG. 4(B), the diameter of the connector cover 32 becomes smaller from its one end where the connector 30 is mounted to its other side. A flange 32*a* for locking use is provided sideways by projecting it from both peripheral edges of the connector cover 32 at the one end thereof having the largest diameter. The flange 32*a* is locked to a concave portion 30*a* formed on the connector 30 to mount the connector cover 32 on the connector 30. The other end of the connector cover 32 having the smallest diameter is formed as an opening 32*b*. The wire harness W/H lead out straight to the outside from the opening 32*b* is fixed to a tape-winding tongue piece 32*c* formed at the peripheral edge of the opening 32*b* by winding a tape T round the tape-winding tongue piece 32*c*. At this time, the connected portion at which the drain wire 11 of the shielded wire 10 and the ground wire 50 are connected with each other is accommodated in the connector cover 32. A slit 32*d* is formed on the connector cover 32 from the one end thereof to the other end thereof At the other end of the shielded wire 10, the sheath 14 and the shielding layer 13 are also cut to peel a part of the sheath 14 and the shielding layer 13 to lead out the core electric wire 12 from the shielding layer 13, and a waterproof connector 34 is connected with the end of the lead out core electric wire 12 of each shielded wire 10. The waterproof connector 34 has a waterproof function for the core electric wire 12 because the waterproof connector 34 has a water-stop rubber stopper 34*a*. Each waterproof connector 34 is connected with a sensor.

The ground wire 50 is not connected with the waterproof connector 34. Thereby water which has penetrated from one end of the shielded wire 10 into the other end thereof is drained to the other end thereof. The entire wire harness W/H prevents water from penetrating into sensors (or electric circuit) from the outside of the waterproof connector 34 and the core electric wire 12.

The shielded wire-grounding method is described below.

Figure 6A:
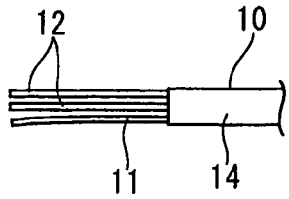
FIGS. 6(A) through 6(F) show a shielded wire-grounding method.

Initially at a first step, as shown in FIG. 6(A), the sheath 14 and the shielding layer 13 are cut to peel the sheath 14 and the shielding layer 13 in a length spaced by about 40 mm from the front end of the shielded wire 10 to lead out the drain wire 11 and the core electric wires 12 in a length of about 40 mm.

Figure 6B:
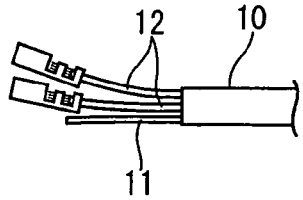

At a second step, as shown in FIG. 6(B), a crimping terminal is connected to ends of the core electric wires 12 and the electric wire 20 other than the shielded wire 10 respectively by the crimping connection. In FIG. 6(B), only the shielded wire 10 is shown.

Figure 6C:
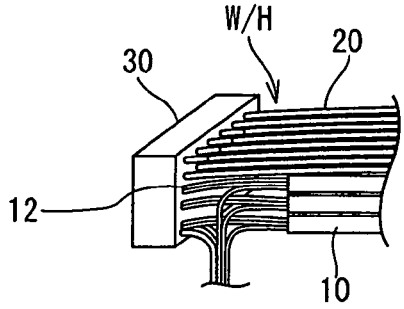

At a third step, as shown in FIG. 6(C), the crimping terminals connected to the ends of the core electric wires 12 and the electric wire 20 other than the shielded wire 10 are inserted into the cavities of the connector 30 to lock the crimping terminal thereto.

Figure 6D:
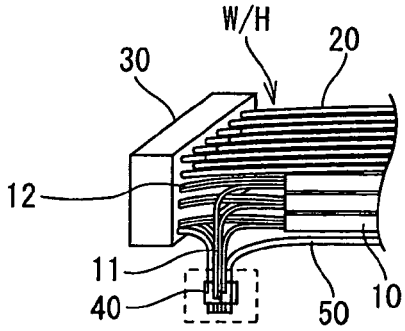

At a fourth step, as shown in FIG. 6(D), the drain wires 11 and the ground wire 50 are connected with each other by the crimping connection by means of the intermediate crimping terminal 40.

Figure 6E:
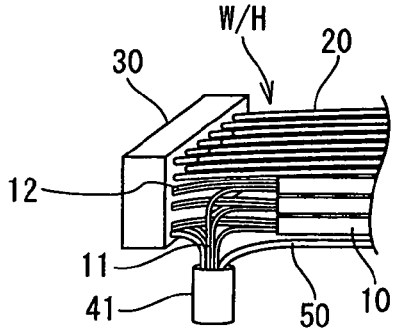

At a fifth step, as shown in FIG. 6(E), the cap 41 is mounted on the connected portion at which the drain wires 11 and the ground wire 50 are connected with each other.

Figure 6F:
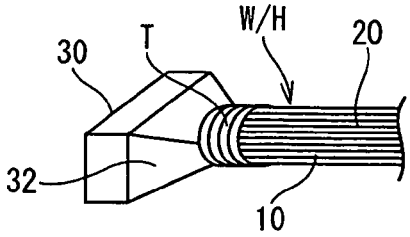

At the last step, namely, at a sixth step, as shown in FIG. 6(F), the connector cover 32 is mounted on the connector 30 to cover the connected portion at which the connector 30 and the wire harness W/H are connected with each other by means of the connector cover 32, and the connected portion at which the drain wires 11 and the ground wire 50 are connected with each other is accommodated inside the connector cover 32.

In the shielded wire-grounding construction formed by using the above-described method, the drain wire 11 of the shielded wire 10 and the ground wire 50 are connected with each other by means of the intermediate crimping terminal 40 by the crimping connection. Therefore the method of the present invention is capable of decreasing the lead-out length of the drain wire 11 to 40 mm at the shortest, as compared with the case in which the drain wires 11 and the ground wire 50 are connected with each other by welding the portion of the drain wire 11 to be connected and the portion of the ground wire 50 to be connected to each other. Because it is possible to decrease the peeling length of the shielded wire 10 by the above-described length, the performance of shielding the shielded wire 10 can be enhanced.

Further because the length of the exposed portion of each of the drain wires 11 to be connected with the ground wire 50 is short, it is unnecessary to perform a tape-winding operation in aligning the tips of the drain wires 11 with each other. Thus it is possible to decrease the number of operation steps.

By accommodating the connected portion at which the drain wire 11 and the ground wire 50 are connected with each other inside the connector cover 32 mounted on the connector 30 connected with the end of the wire harness W/H, the connected portion at which the drain wire 11 and the ground wire 50 are connected with each other is little influenced by external vibration and heat. Thus it is possible to enhance the performance of protecting the connected portion. Thereby it is unnecessary to fix the connected portion at which the drain wire 11 and the ground wire 50 are connected with each other to the wire harness W/H by winding the tape T round the wire harness W/H. Therefore it is possible to make the wire harness W/H slim by restraining the wire harness W/H from becoming locally large and enhance the operability.

In connecting the drain wire 11 of the shielded wire 10 and the ground wire 50 with each other, it is unnecessary to transport the shielded wire 10 and the ground wire 50 from a production line to a welding apparatus and possible to accomplish the above-described all steps on one production line. Thus it is possible to enhance operation efficiency.

When an operation is performed in the order from the first step through the sixth step, in connecting the drain wire 11 and the ground wire 50 with each other by the crimping connection, the core electric wires 12 of the shielded wires 10 and the electric wire 20 other than the shielded wires 10 are prevented from being separated from each other because these wires are all connected with the connector 30. Thus it is easy to perform the crimping connection operation.

The operation order of the first step through the sixth step is not limited to the above-described order. After the first step is carried out, it is possible to carry out the steps in any desired order as follows, second step→fourth step→third step→fifth step, second step→fourth step→fifth step→third step, fourth step→second step→third step→fifth step, fourth step→second step→fifth step→third step, and fourth step→fifth step→second step→third step. Of these orders, it is especially favorable to perform the second step continuously with the fourth step at which the terminals are connected with the electric wires by the crimping connection.

As apparent from the foregoing description, in the method of the first embodiment of connecting the shielded wires and the ground wire with each other, it is possible to enhance the degree of freedom in the steps of producing the wire harness W/H.

Figure 7:
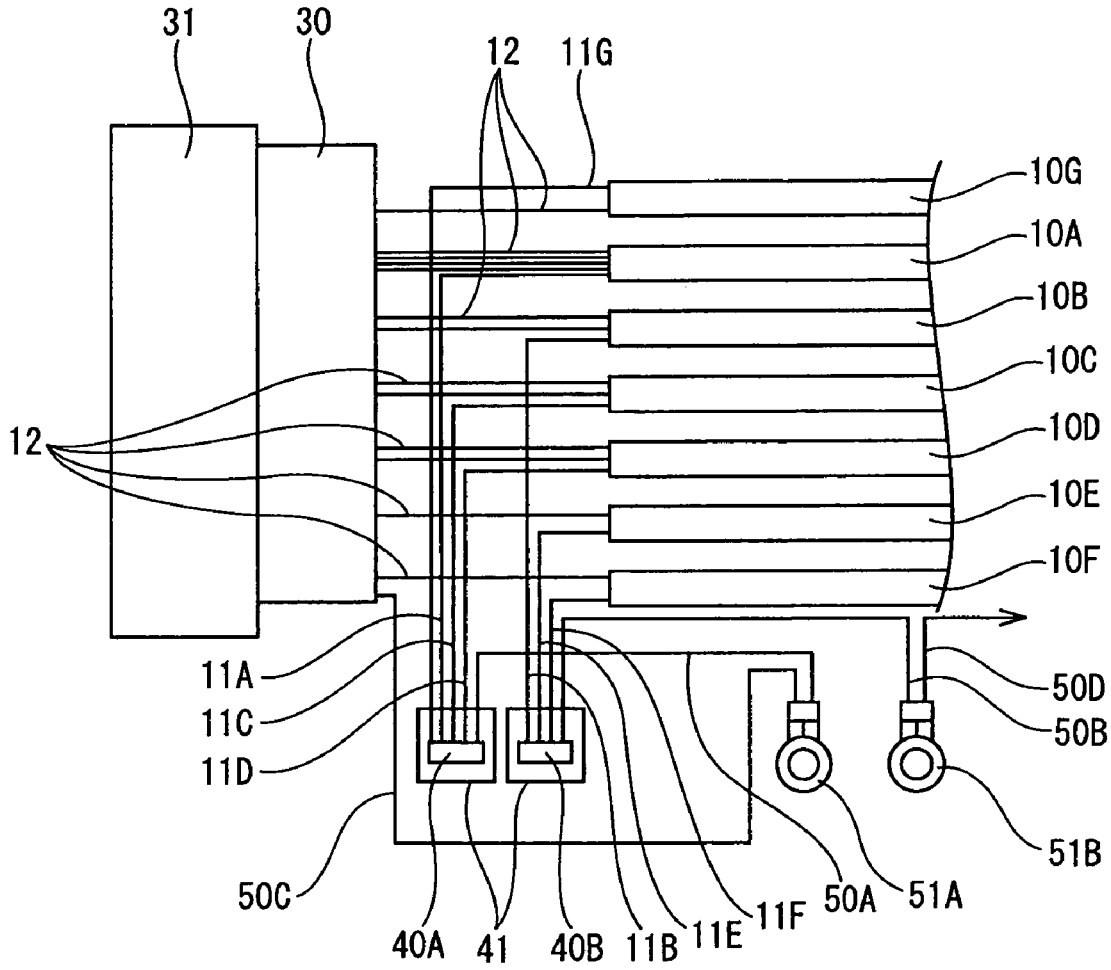
FIG. 7 shows a first modification of the first embodiment.

FIG. 7 shows a first modification of the first embodiment.

In the first modification, the drain wire 11G of the shielded wire 10G is not connected with the connector 30, but is connected with the ground wire 50A together with the other drain wires 11A, 11C, and 11D by means of the intermediate crimping terminal 40A by the crimping connection.

As described above, in the first modification, the drain wires 11 of all the shielded wires 10 are not connected with the connector, but grounded to the car body panel through the ground wire 50.

Figure 8:
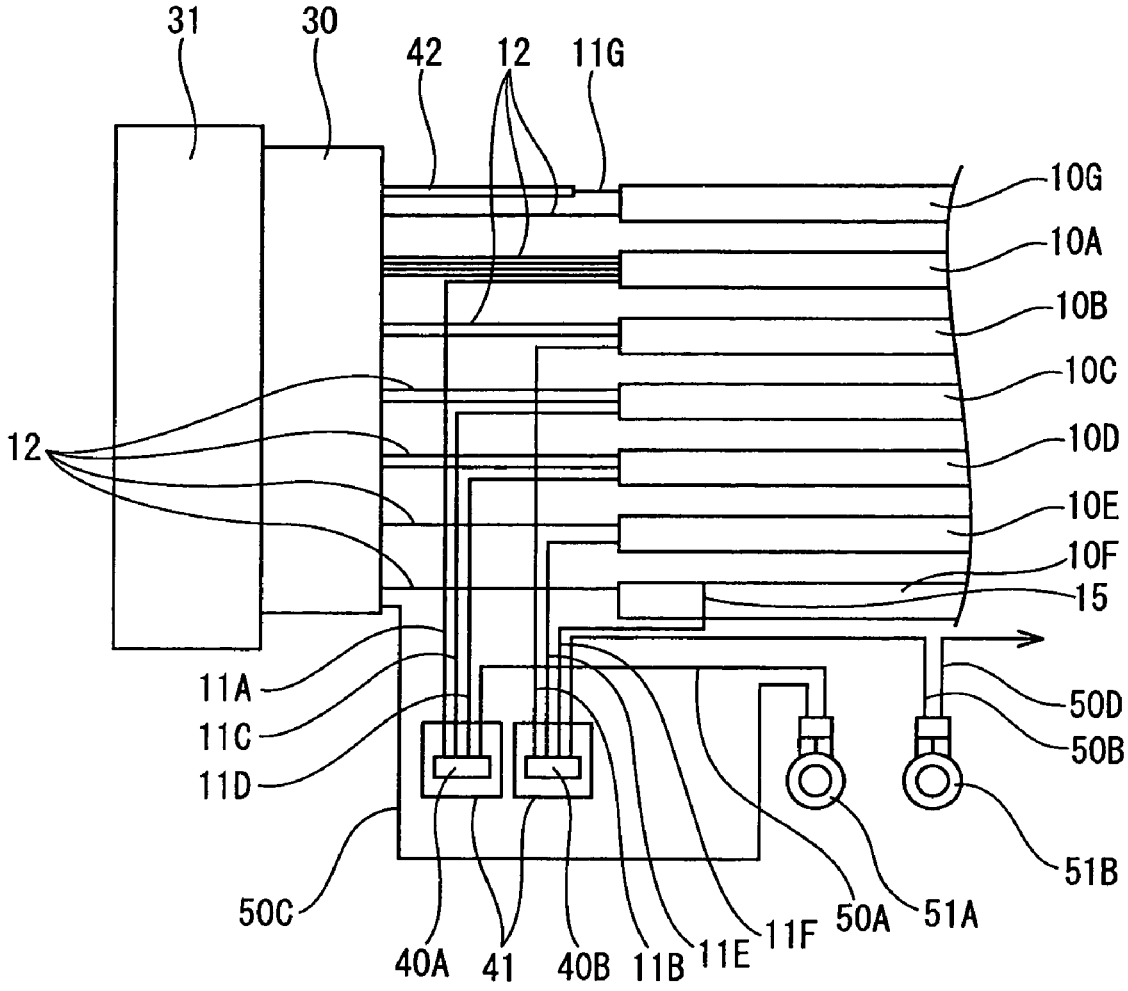
FIG. 8 shows a second modification of the first embodiment.

FIG. 8 shows a second modification of the first embodiment.

In the second modification, a slit 15 is formed through a portion, of the shielding layer 13 and the sheath 14, which is disposed at an intermediate position of the shielded wire 10F, and the drain wire 11F is lead out from the slit 15 to connect the drain wire 11F to the ground wire 50B together with the drain wires 11B, 11E of the other shielded wires 10B and 10E by means of an intermediate crimping terminal 40B.

The drain wire 11 may be lead out from an intermediate position of the other shielded wires 10A through 10E and 10G.

Figure 9A:
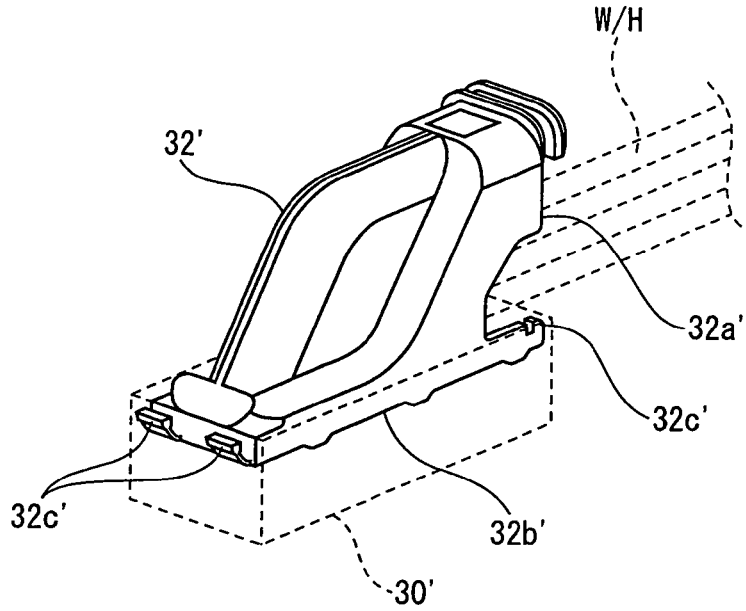
FIGS. 9(A) through 9(C) show a third modification of the first embodiment.
Figure 9B:
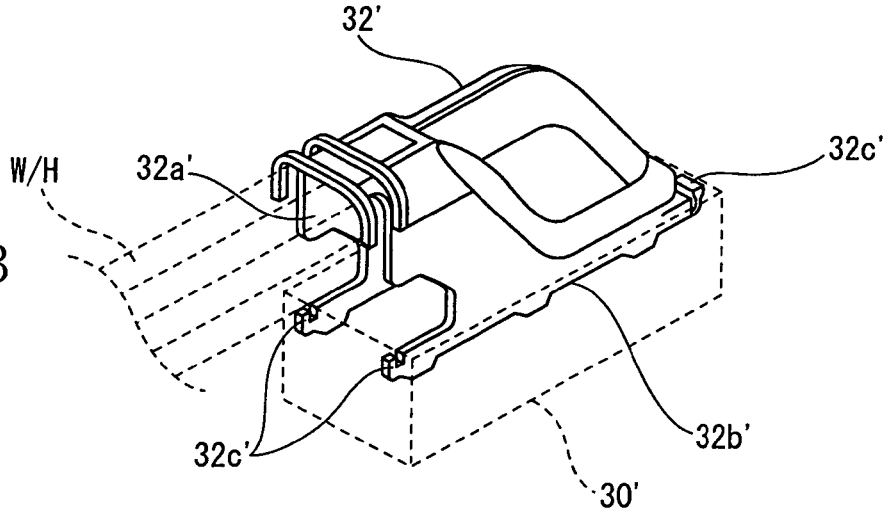
Figure 9C:
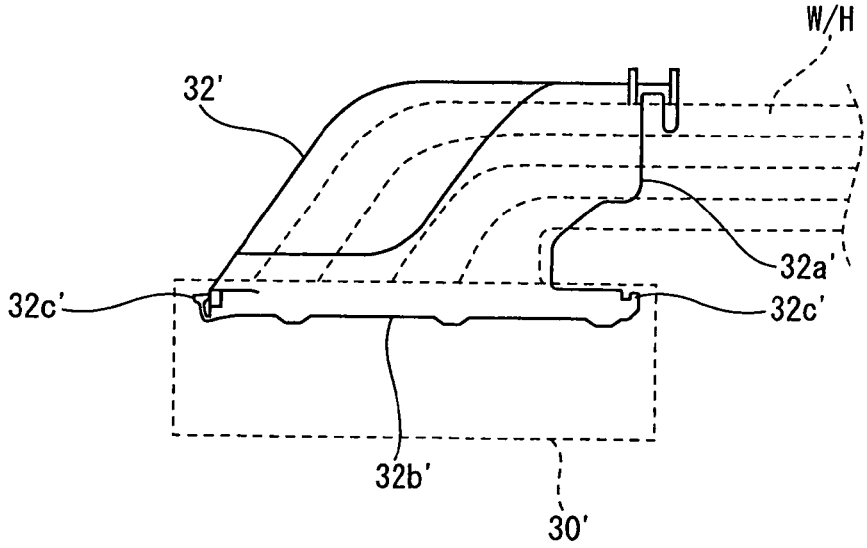

FIG. 9 shows a third modification of the first embodiment.

In the third modification, the configuration of the connector cover to be mounted on the connector is different from that of the connector cover of the first embodiment. An opening 32*a*' of a connector cover 32' from which the wire harness is lead out is formed on a peripheral wall thereof orthogonal to a mounting surface 32*b*' to be mounted on the connector 30. The wire harness W/H connected with the connector is lead out sideways from the opening 32*a*'.

A locking claw 32*c*' is formed at a necessary position of the mounting surface 32*b*' of the connector cover 32'. The locking claw 32*c*' is locked to the connector 30 to mount the connector cover 32' on the connector 30.

Figure 10:
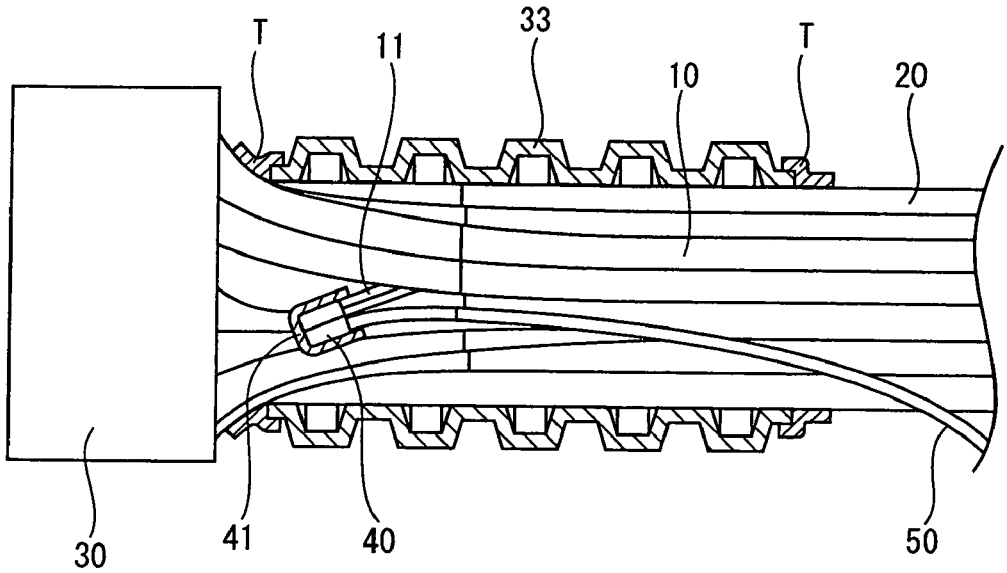
FIG. 10 shows a fourth modification of the first embodiment.

FIG. 10 shows a fourth modification of the first embodiment.

In the fourth modification, the connector cover is not mounted on the connector 30. A cylindrical corrugate tube 33 having mountains and valleys axially alternately formed is externally mounted on the shielded wire 10 and the electric wire 20 other than the shielded wire 10. The corrugate tube 33 accommodates the connected portion at which the drain wire 11 of the shielded wires 10 and the ground wire 50 are connected with each other by the crimping connection.

In the above-described construction, the corrugate tube 33 accommodates the connected portion at which the drain wire 11 and the ground wire 50 are connected with each other by the crimping connection. Therefore without winding a tape round the wire harness W/H, it is possible to dispose the connected portion at which the drain wire 11 and the ground wire 50 are connected with each other along the wire harness W/H.

Other constructions and operations and effects of the fourth modification are similar to those of the first embodiment. Thus the same parts of the fourth modification as those of the first embodiment are denoted by the same reference numerals as those of the first embodiment, and description thereof is omitted herein.

Figure 11:
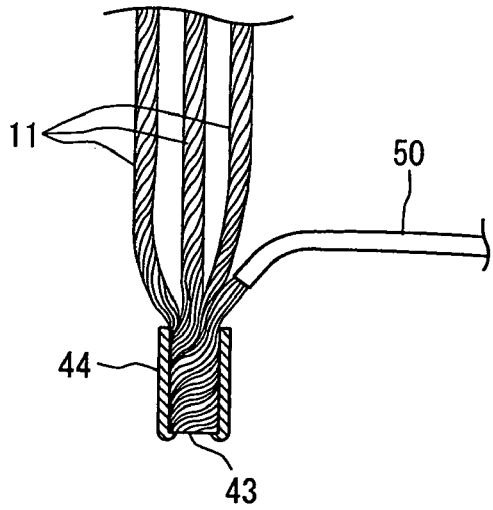
FIG. 11 shows a second embodiment of the present invention.
Figure 12:
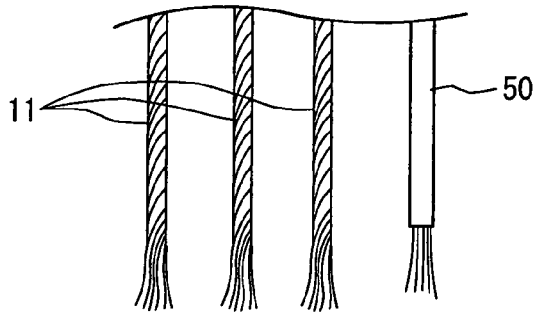
FIG. 12 shows a state in which strands of the drain wire and those of the ground wire are untwisted.

FIGS. 11 and 12 show a second embodiment.

In the second embodiment, the method of connecting the drain wire 11 and the ground wire 50 with each other is different from that of the first embodiment. The drain wire 11 and the ground wire 50 are connected with each other by twisting strands of the drain wire 11 and those of the ground wire 50.

More specifically, as shown in FIG. 12, the strands of the drain wire 11 and those of the ground wire 50 are untwisted, bundled, and twisted to form a connected portion 43. After the connected portion 43 is covered with a cylindrical heat-shrinkable tube 44, the heat-shrinkable tube 44 is heated to shrink it so that the heat-shrinkable tube 44 adheres to a peripheral surface of the connected portion 43.

The heat-shrinkable tube 44 is a waterproof shrinkable tube containing a thermoplastic adhesive agent in its inner wall. By thermally shrinking the heat-shrinkable tube 44, the adhesive agent fuses, thus adhering to the outer side of the twisted drain wire and the ground wire.

In the above-described construction, it is possible to obtain an effect similar to that of the first embodiment and eliminate the need for using the intermediate crimping terminal in connecting the drain wire 11 and the ground wire 50 with each other. The connected portion 43 formed by twisting the strands of the drain wire 11 and those of the ground wire 50 is covered with the cylindrical heat-shrinkable tube 44 which adheres to the peripheral surface of the connected portion 43. Therefore the strands of the drain wire 11 and those of the ground wire 50 are prevented from being untwisted. Thus an electrical connection therebetween can be secured.

Other constructions and operations and effects of the second embodiment are similar to those of the first embodiment. Thus the same parts of the second embodiment as those of the first embodiment are denoted by the same reference numerals as those of the first embodiment, and description thereof is omitted herein.

FIG. 13 shows a modification of the second embodiment.

Figure 13A:
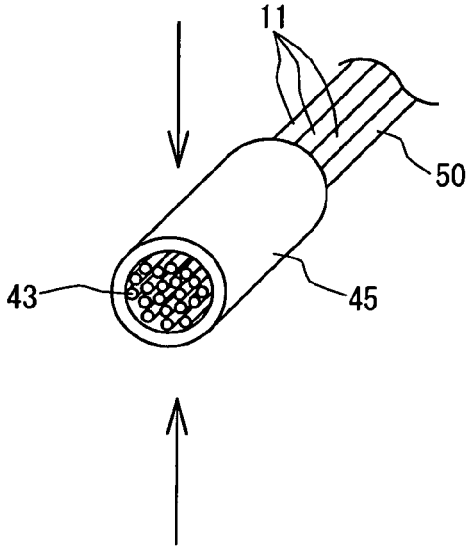
FIGS. 13(A) and 13(B) show a modification of the second embodiment.
Figure 13B:
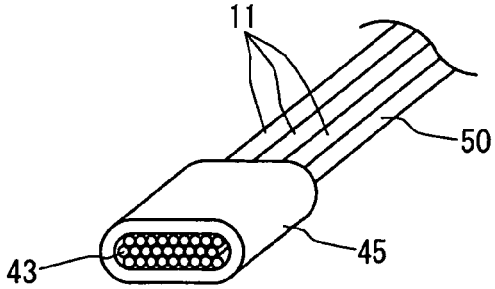

In the modification, as shown in FIG. 13(A), after the connected portion 43 formed by twisting the strands of the drain wire 11 and those of the ground wire 50 is covered with a cylindrical metal tube 45, the metal tube 45 is caulked in a direction from both sides thereof to crimp the metal tube 45 to the connected portion 43, as shown in FIG. 13(B).

In the above-described construction, the metal tube 45 is crimped to the connected portion 43 formed by twisting the strands of the drain wire 11 and those of the ground wire 50. Therefore the strands of the drain wire 11 and those of the ground wire 50 are prevented from being untwisted. Further the strands of the drain wire 11 and those of the ground wire 50 are electrically conductive even though the connected portion 43 is covered with the metal tube 45. Thus it is possible to secure a high electrical connection between the strands of the drain wire 11 and those of the ground wire 50.

The metal tube 45 crimped to the connected portion 43 at which the drain wire 11 and the ground wire 50 are connected with each other may be covered with a cap similar to that of the first embodiment.

Figure 14:
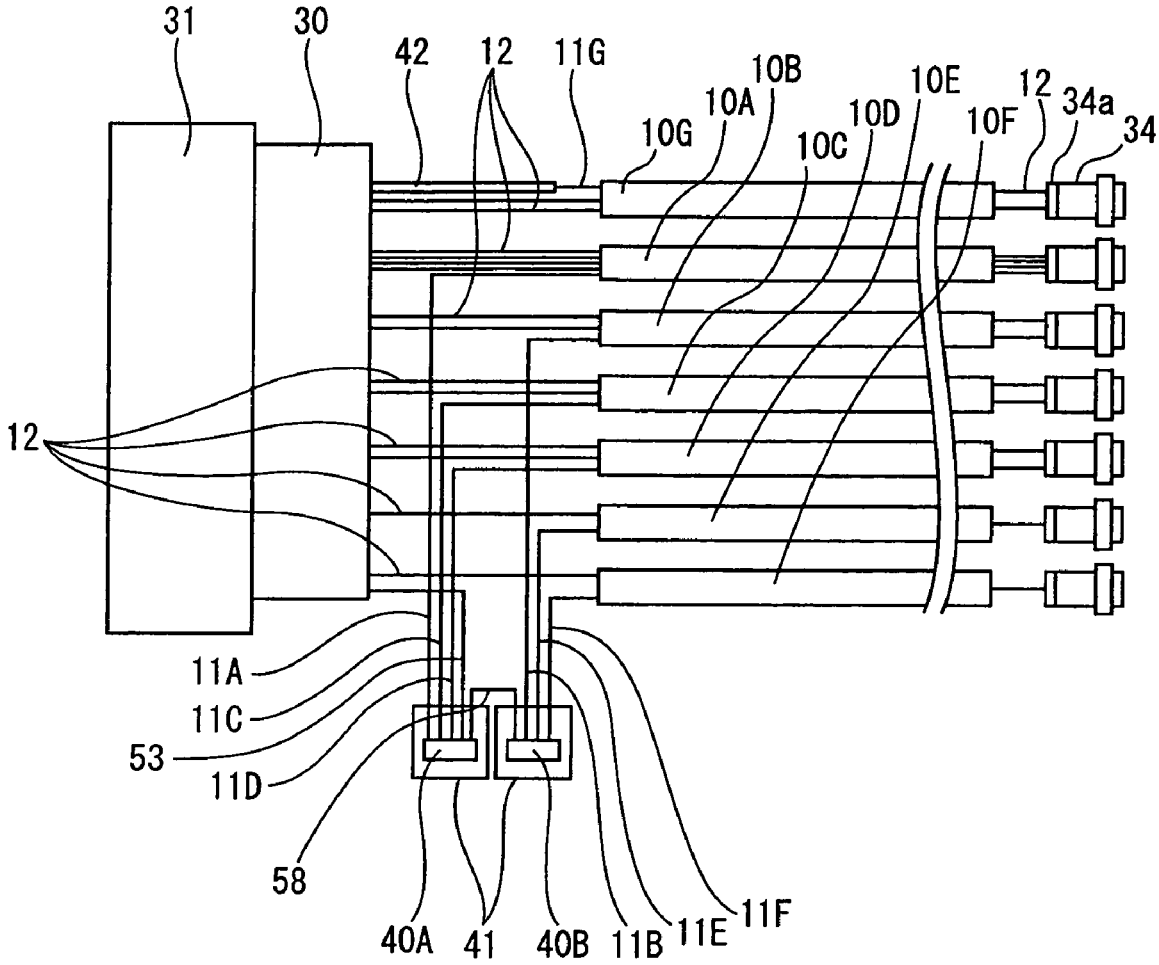
FIG. 14 shows a third embodiment of the present invention.
Figure 15:
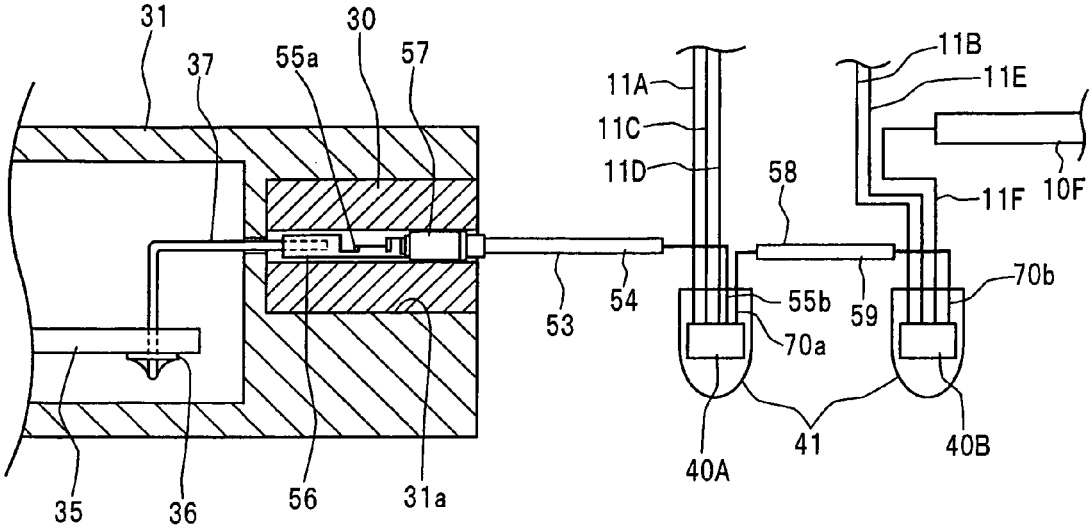
FIG. 15 is main part-enlarged view showing a state where the drain wire and the ground wire are connected to each other.

FIGS. 14 and 15 show a third embodiment.

In the third embodiment, the construction of the ground wire to be connected with the drain wire 11 is different from that of the above-described embodiments.

More specifically, as shown in FIG. 15, a ground wire 53 consists of a single core wire having a conductor covered with an insulating coating 54. A connector accommodation terminal 56 accommodated inside the connector 30 is connected to a conductor 55*a* exposed at one end of the ground wire 53 by peeling the insulating coating 54, whereas a conductor 55*b* disposed at the other end of the ground wire 53 is connected to the drain wires 11A, 11C, and 11D by means of the intermediate crimping terminal 40A. The sectional area of the conductor 55 of the ground wire 53 is set to 0.5 $mm^2$, 0.75 $mm^2$ or 1.25 $mm^2$. The core electric wire 12 is connected to the connector 30 connected with the connector accommodation terminal 56 connected with the ground wire 53.

As shown in FIG. 15, a water-stop portion consisting of a water-stop rubber stopper 57 is provided at the connected portion at which the ground wire 53 and the connector accommodation terminal 56 are connected with each other, and the peripheral surface of the water-stop rubber stopper 57 is brought into close contact with the inner peripheral surface of a cavity 30*b* of the connector 30 to prevent water from penetrating into the connector 30.

A circuit member consisting of a printed-circuit board 35 is accommodated inside an electronic control unit composed of the fuel injection control apparatus 31 to which the connector 30 is connected. When the connector 30 is fitted in a connector accommodation portion 31*a* of the fuel injection control apparatus 31 to connect the connector 30 with the connector accommodation portion 31*a*, the connector accommodation terminal 56 connected with the ground wire 53 accommodated inside the connector 30 is connected with a terminal member 37 connected with a conductor 36 constructing a ground circuit of the printed-circuit board 35.

The connected portion at which the drain wires 11A, 11C, and 11D and the ground wire 53 are connected with each other is connected with the connected portion at which the drain wires 11B, 11E, and 11F are connected with each other through a ground wire 58 for relay connection use. The ground wire 58 for relay connection use consists of a single core wire whose conductor is covered with an insulating coating 59. A conductor 70*a* exposed at one end of the ground wire 53 by peeling the insulating coating 59 is connected to the drain wires 11A, 11C, and 11D and the ground wire 53 by means of the intermediate crimping terminal 40A by the crimping connection. A conductor 70*b* disposed at the other end of the ground wire 58 is connected with the drain wires 11B, 11E, and 11F by means of an intermediate crimping terminal 40B by the crimping connection.

In the above-described construction, when the connector 30 connected with the end of the core electric wire 12 and that of the ground wire 53 is connected to the electronic control unit, the connector accommodation terminal 56 connected with the ground wire 53 is connected with the ground circuit of the printed-circuit board 35 accommodated in the electronic control unit. Thus the ground connection can be easily accomplished.

Further it is unnecessary to wire the ground wire 53 to the car body panel and thus possible to decrease the length thereof. Thus it is possible to simplify the shielded wire-grounding construction.

Furthermore because the ground wire 53 consists of the single core wire whose conductor is covered with the insulating coating 54, no gap is formed between the conductor 55 and the insulating coating 54. Therefore it is possible to prevent water which has penetrated into the connected portion at which the drain wire 11 and the ground wire 53 are connected with each other from penetrating into the connector 30, because there is no gap between the conductor 55 of the ground wire 53 and the insulating coating 54.

In addition because a plurality of connected portions is connected with each other through the ground wire 58 for relay connection use, all the drain wires 11 can be connected with the ground wire 53 by connecting the ground wire 53 to one connected portion. Thereby it is unnecessary to provide each connected portion with the ground wire 53, one end of which is connected with the connector accommodation terminal 56 and thus possible to decrease the number of the connector accommodation terminals 56.

The drain wire 11 and the ground wire 50 may be connected with each other by twisting the strands thereof.

As the ground wire 58, for relay connection use, which connects the connected portions of the drain wire 11 and the ground wire 50 with each other, not only the ground wire connected with the connector accommodation terminal, but also the ground wire connected with the ground terminal connected with the car body panel can be used.

Other constructions, operations, and effects of the third embodiment are similar to those of the first embodiment. Thus the same parts of the third embodiment as those of the first embodiment are denoted by the same reference numerals as those of the first embodiment, and description thereof is omitted herein.

Figure 16:
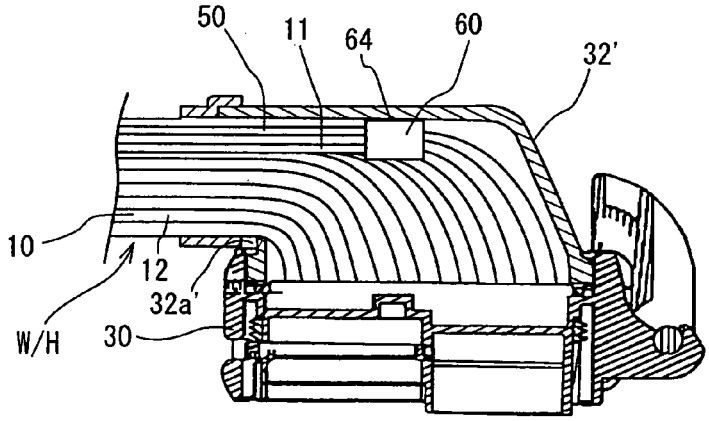
FIG. 16 is a sectional view showing a shielded wire-grounding construction in a fourth embodiment of the present invention.
Figure 17:
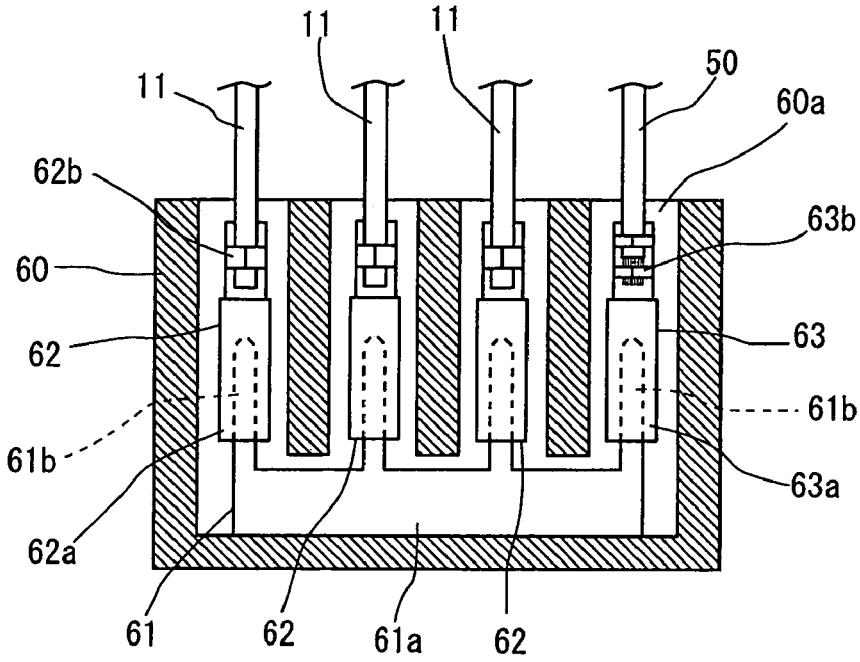
FIG. 17 is a sectional view of a joint connector.

FIGS. 16 and 17 show a fourth embodiment of the present invention.

In the fourth embodiment, the drain wire 11 of the shielded wire 10 and the ground wire 50 are connected with each other through a joint bus bar 61 disposed inside a joint connector 60.

More specifically, crimping terminals 62, 63 are connected to a lead-out side end of each drain wire 11 lead out from the shielded wire 10 and to conductors disposed at other end of the ground wire 50 disposed at a side opposite to one end thereof connected with a ground terminal. The crimping terminals 62, 63 have female terminals 62*a*, 63*a* respectively connected with the joint bus bar 61 at one end thereof and crimping barrels 62*b*, 63*b* at the other end thereof. The crimping barrels 62*b* and 63*b* are caulked to the drain wires 11 and the ground wire 50 to connect the drain wires 11 and the ground wire 50 with each other by the crimping connection.

The joint bus bar 61 connecting the drain wires 11 and the ground wire 50 to each other has a belt-shaped joint portion 61*a* and a plurality of male tab-shaped terminal portions 61*b* projected from the joint portion 61*a*. The joint bus bar 61 is accommodated inside the joint connector 60 made of resin molding. The terminal portions 61*b* of the joint bus bar 61 are disposed respectively in the cavities 60*a* of the joint connector 60. The crimping terminals 62 of the drain wires 11 and the crimping terminal 63 of the ground wire 50 are inserted into the cavities 60*a* and locked thereto to connect the female terminal portions 62*a*, 63*a* of the female crimping terminals 62, 63 to the terminal portions 61*b* of the joint bus bar 61 respectively. Thereby the drain wires 11 and the ground wire 50 are connected with each other through the joint bus bar 61.

Through an adhesive agent 64, the joint connector 60 is fixed to an inner wall of a connector cover 32', similar to that of the second embodiment, mounted on the connector 30 to which the core electric wire 12 of the shielded wire 10 is connected. The drain wires 11 connected with the joint connector 60 and the ground wire 50 connected therewith are lead out through an opening 32*a*' of the connector cover 32'.

The shielded wire-grounding method is described below.

Initially at a first step, the sheath 14 and the shielding layer 13 are cut to peel them in a length spaced by about 40 mm from the front end of the shielded wire 10 to lead out the drain wire 11 and the core electric wires 12 in a length of about 40 mm.

At a second step, crimping terminals 62, 63 are connected to ends of the drain wire 11, the core electric wires 12, the ground wire 50, and the electric wire 20 other than the shielded wire 10 respectively by crimping connection.

At a third step, the crimping terminals connected to the ends of the core electric wires 12 and the electric wire 20 other than the shielded wire 10 are inserted into the cavities of the connector 30 and locked thereto.

At a fourth step, the crimping terminals 62 of the drain wires 11 and the crimping terminal 63 of the ground wire 50 are inserted into the cavities 60*a* of the joint connector 60 and locked thereto to connect the drain wires 11 and the ground wire 50 to each other through the joint bus bar 61.

At a fifth step, with an adhesive agent 64, the joint connector 60 is fixed to the inner wall of the connector cover 32' mounted on the connector 30.

At the last step, namely, at a sixth step, the connector cover 32' is mounted on the connector 30 to cover the connected portion at which the connector 30 and the wire harness W/H are connected with each other by means of the connector cover 32, and the joint connector 60 is accommodated inside the connector cover 32.

The operation of the fourth step and that of the fifth step may be performed in a reverse order.

In the shielded wire-grounding construction formed by using the above-described method, similarly to the first embodiment, welding is unnecessary in connecting the drain wires 11 of the shielded wire 10 and the ground wire 50 to each other. Therefore the method of the present invention is capable of decreasing the lead-out length of the drain wire 11 to 40 mm at the shortest, as compared with the case in which the portion of the drain wire 11 to be connected and the portion of the ground wire 50 to be connected are connected with each other by welding the portions thereof to each other. Because it is possible to decrease the peeling length of the shielded wire 10 by the above-described length, it is possible to enhance the performance of shielding the shielded wire 10.

The joint connector 60 connecting the drain wires 11 and the ground wire 50 to each other is accommodated in the connector cover 32 by fixing the joint connector 60 to the inner wall of the connector cover 32' mounted on the connector 30 connected with the end of the wire harness W/H, the joint connector 60 is little influenced by external vibration and heat. Thus it is possible to enhance the performance of protecting the joint connector 60. Thereby it is unnecessary to fix the joint connector to the wire harness W/H by winding a tape round the wire harness W/H. Therefore it is possible to restrain the wire harness W/H from becoming locally large and thus make the wire harness W/H slim and enhance the operability.

In connecting the drain wires 11 of the shielded wire 10 and the ground wire 50 to each other, it is unnecessary to transport the shielded wire 10 and the ground wire 50 from a production line to a welding apparatus and possible to perform the above-described all production steps in one production line. Thus it is possible to enhance the operation efficiency.

The terminal to be connected to the drain wires 11 and the ground wire 50 is not limited to the crimping terminal, but a pressure-welded terminal having a pressure welding slot may be used.

As in the case of the third embodiment, the ground wire may consist of the single core wire with which the connector accommodation terminal is connected to one end thereof Other constructions and operations and effects of the fourth embodiment are similar to those of the first embodiment. Thus the same parts of the fourth embodiment as those of the first embodiment are denoted by the same reference numerals as those of the first embodiment, and description thereof is omitted herein.

Figure 18:
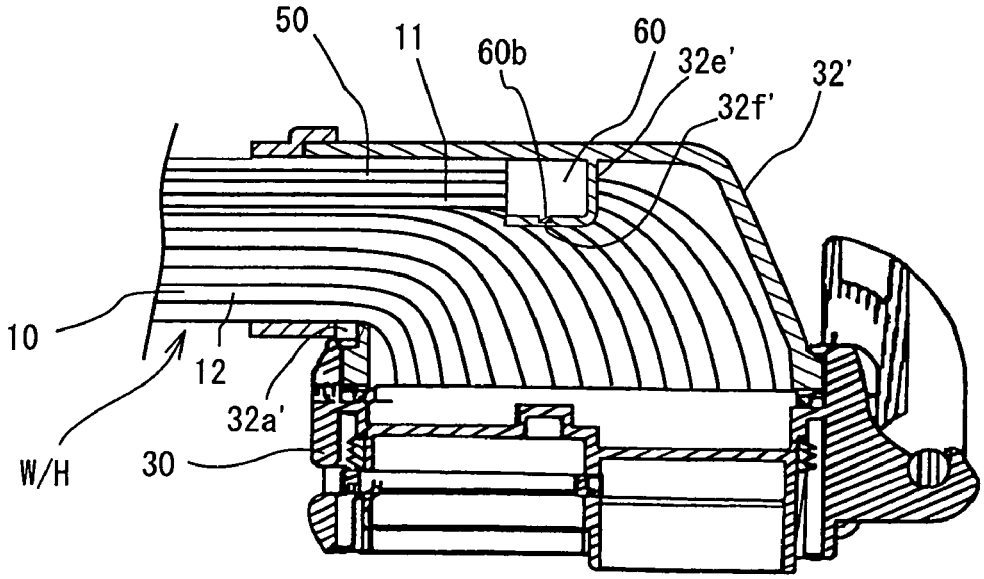
FIG. 18 shows a modification of the fourth embodiment.
Figure 19:
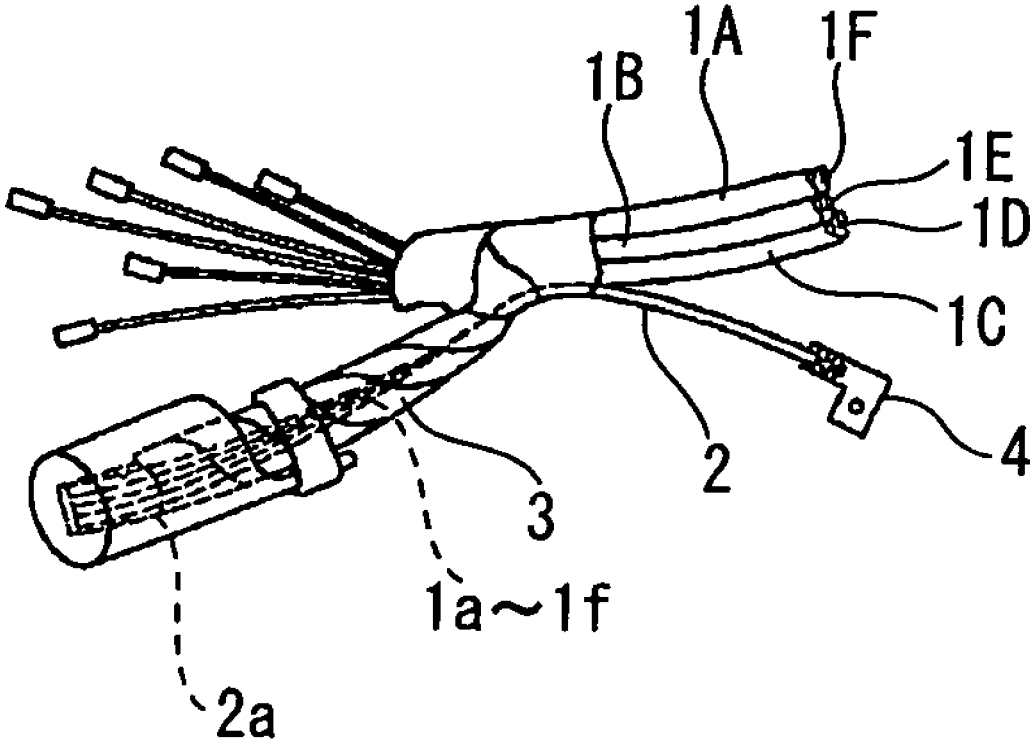
FIG. 19 shows an example of a conventional art.

FIG. 18 shows a modification of the fourth embodiment.

In the modification, the joint connector 60 is not fixed to the inner wall of the connector cover 32' through an adhesive agent, but a connector accommodation portion 32*e'* for accommodating the joint connector 60 therein is formed integrally with the inner wall of the connector cover 32'. A locking groove 32*f'* is formed on the inner surface of the connector accommodation portion 32*e'*, and a locking claw 60*b* is formed on an outer surface of the joint connector 60. By locking the locking claw 60*b* of the joint connector 60 to the locking groove 32*f'* of the connector accommodation portion 32*e'*, the joint connector 60 is fixed to the inside of the connector accommodation portion 32*e'* of the connector cover 32'.

In the fourth embodiment and the modification of the fourth embodiment, the joint connector 60 may be set on any desired positions of the inner wall of the connector cover 32'.

What is claimed is:

1. A shielded wire-grounding construction comprising a plurality of shielded wires each having a core electric wire including an insulated coated electric wire; a shielding layer, composed of a metal foil tape or a braided metal tube, which is disposed on a periphery of said core electric wire; a drain wire in contact with said shielding layer; and a sheath including an insulating coating which coats said drain wire and said shielding layer, said core electric wires of a plurality of said shielded wires being connected to one connector, wherein said drain wire is lead out from a front end of each of said shielded wires at a side of connection thereof to said connector or from an intermediate position of each of said shielded wires; and lead-out side front ends of a plurality of said drain wires lead out are connected to a conductor disposed at other end of one ground wire, one end of which is connected with a ground terminal, by a collective crimping connection that includes a sectionally U-shaped intermediate crimping terminal having a pair of barrels opposed to each other to form a connected portion;

said connected portion formed by said collective crimping connection is covered with a cap made of insulating resin;

said connected portion, formed by said collective crimping connection, which is covered with said cap is accommodated inside a connector cover mounted on said connector or inside a corrugated tube externally mounted on said shielded wires; and said ground terminal of said ground wire is grounded to a car body.

2. A shielded wire-grounding construction according to claim 1, wherein said drain wires lead out from two to five of said shielded wires are connected to said conductor exposed from said other end of said one ground wire.

3. A shielded wire-grounding construction according to claim 1, wherein a portion of a sheath is peeled at a front part of each of said shielded wires to lead out said drain wire and said core electric wire in a length of 40 to 80 mm; and said drain wire lead out is connected to said ground wire through an intermediate crimping terminal; and a connector accommodation terminal is connected to end of said core electric wire by crimping connection.

4. A shielded wire-grounding construction according to claim 1, wherein a plurality of connected portions is formed by a plurality of said drain wires collectively crimped to each other by an intermediate crimping terminal; and a ground wire for relay connection use, for connectedly relaying a plurality of said connected portions formed by said collective crimping connection, connects said drain wires and said ground wire at one of said connected portions formed by said collective crimping connection.

5. A shielded wire-grounding construction according to claim 1, wherein a water-stop rubber stopper is mounted on a crimping terminal portion where said ground terminal is crimped to said ground wire or a water-stop portion is formed on said crimping terminal portion by dripped silicone.

6. A shielded wire-grounding construction according to claim 1, wherein a waterproof rubber stopper is mounted on said connector accommodation terminal disposed at said end of said core electric wire inserted into said connector and locked thereto.

* * * * *